US007819722B2

(12) United States Patent
Peterman, Jr. et al.

(10) Patent No.: US 7,819,722 B2
(45) Date of Patent: Oct. 26, 2010

(54) APPARATUS AND METHOD FOR MANUFACTURING ABRASIVE TOOLS

(75) Inventors: Loyal M. Peterman, Jr., Dublin, OH (US); Yefim Vernik, Vernon Hills, IL (US)

(73) Assignee: Abrasive Technology, Inc., Lewis Center, OH (US)

( * ) Notice: Subject to any disclaimer, the term of this patent is extended or adjusted under 35 U.S.C. 154(b) by 242 days.

(21) Appl. No.: 11/754,739

(22) Filed: May 29, 2007

(65) Prior Publication Data

US 2007/0216071 A1 Sep. 20, 2007

Related U.S. Application Data

(62) Division of application No. 11/489,324, filed on Jul. 19, 2006, now Pat. No. 7,393,370.

(51) Int. Cl.
*B24D 5/02* (2006.01)

(52) U.S. Cl. ..... 451/242; 451/541; 51/293

(58) Field of Classification Search ..... 451/541, 451/548, 242; 51/293, 297, 298
See application file for complete search history.

(56) References Cited

U.S. PATENT DOCUMENTS 2,449,407 A 9/1948 Mulholland
2,557,047 A * 6/1951 Goepfert et al. ..... 51/298
2,860,961 A * 11/1958 Gregor et al. ..... 51/298

FOREIGN PATENT DOCUMENTS

GB 1581247 12/1980

* cited by examiner

*Primary Examiner*—Robert Rose
(74) *Attorney, Agent, or Firm*—Jason H. Foster; Kremblas & Foster

(57) ABSTRACT

A compression molding apparatus and method for the manufacture of abrasive layers for abrasive tooling which provides a compression mold space defined between an inflexible wall surface and a flexible wall surface. The apparatus and method of the present invention is particularly well suited to making annular or hollow cylindrical shaped abrasive layers of novel configurations during a single mold cycle useful for grinding wheel and the like, as well as other shapes such as laps, wherein the flexible wall expanded with fluid pressure provides a highly uniform distribution of pressure against the surface of the mold composition being formed. In an annular configuration, the flexible wall is used to radially direct pressure against a molding composition disposed in an annular configuration wherein the axial length of the annular mold shape formed may be many times greater than priorly obtained by the prior art means.

3 Claims, 11 Drawing Sheets

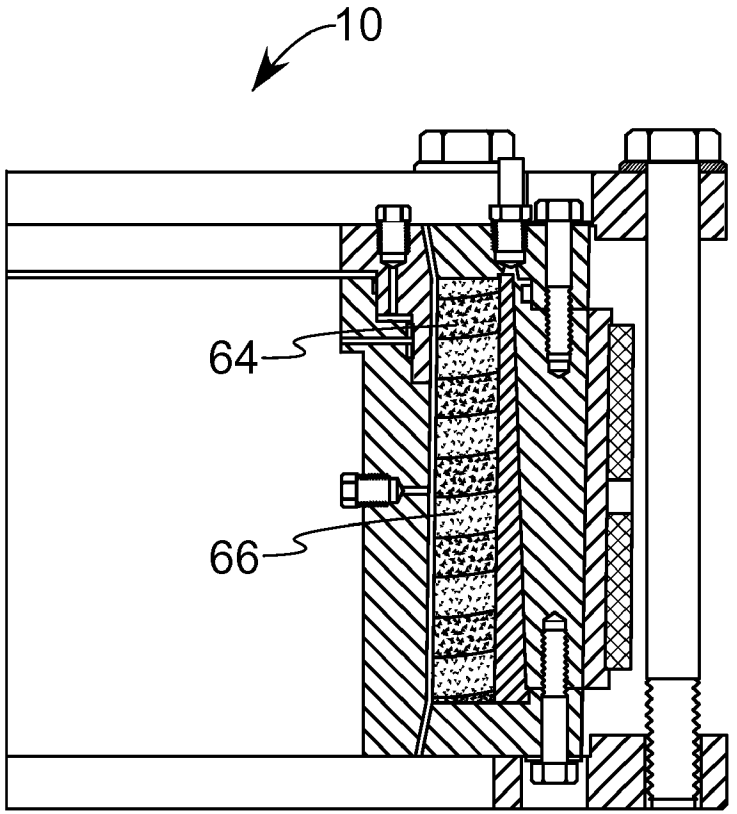
FIG. 5-B
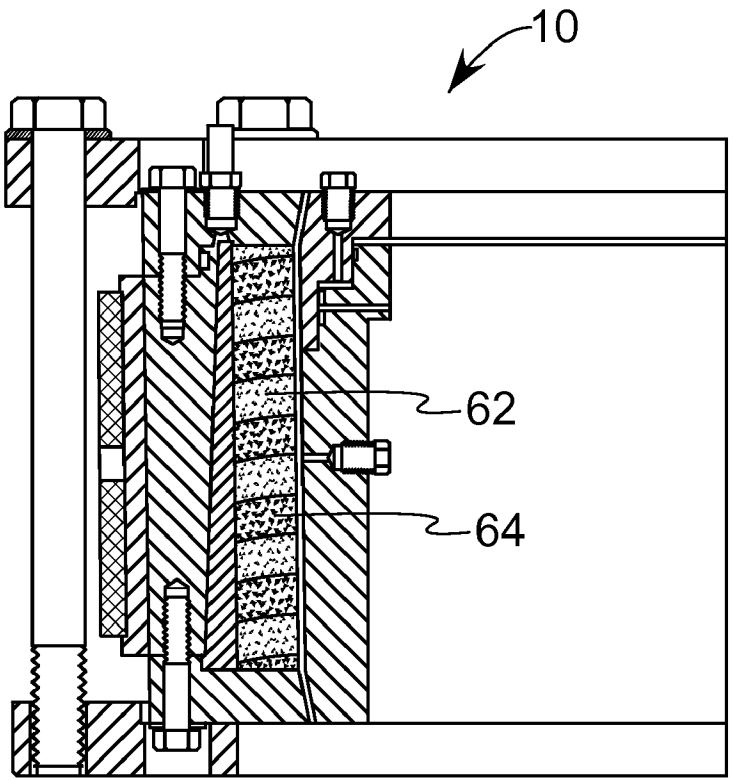
FIG. 5-A

APPARATUS AND METHOD FOR MANUFACTURING ABRASIVE TOOLS

CROSS-REFERENCES TO RELATED APPLICATIONS

This application is a divisional application of U.S. patent application Ser. No. 11/489,324 filed Jul. 19, 2006, which claims the benefit of U.S. Provisional Application No. 60/700,625 filed Jul. 19, 2005.

STATEMENT REGARDING FEDERALLY-SPONSORED RESEARCH AND DEVELOPMENT (Not Applicable)

REFERENCE TO AN APPENDIX (Not Applicable)

BACKGROUND OF THE INVENTION

1. Field of the Invention

This invention relates generally to an apparatus and method of making improved superabrasive tools, such as a centerless grinding wheel, for example.

2. Description of the Related Art

Many types of abrasive tools, such as centerless grinding wheels for example, have been manufactured using a compression molding process to form the outer abrasive surface of the wheel. Large presses involving heat and high pressures, such as 1,000 to 10,000 psi, are employed to compact a powdered composition comprising a resin, metal or ceramic binder, filler materials and superabrasive particles, such as diamonds, for one example, in a mold.

The largest number of such abrasive grinding wheels comprise a resin bonding composition with a variety of such compositions well-known to those skilled in the art and designed for particular applications or as a matter of designer's choice.

One of the problems of the prior conventional molding apparatus and process of this type is the limitation of the axial length dimension which may be acceptably made. This limits the effective width of the annular configuration formed. Typically, only a relatively narrow wheel configuration having an axial length dimension of no more than about 1 to 2 inches may be formed depending upon the particular components of the abrasive composition used and the thickness of the layer of abrasive molding composition formed. Many industrial applications require a grinding surface having up to about 24 inches of width or axial length. Using conventional methods, this requires the separate molding of a plurality of 1 to 2 inch long annular or tubular forms and then adhesively stacking one upon the other to obtain the required axial length. Clearly, this is a costly, labor intensive effort which results in a grinding wheel with seams formed between each of the stacked narrow annular components. Further, since each annular component is made during a separate molding process, uniformity of the properties of each component may vary more than desired.

Since the conventional compression molding apparatus uses annular mold spaces and axially moveable plungers having inflexible surfaces to compact the abrasive composition, the ability to compress the abrasive filled molding composition in an acceptable uniform manner is limited to these narrow axial dimensions. Prior attempts to compress greater depths were unsuccessful as the range of pressure applied throughout the molding composition varied too much to achieve a sufficient uniformity of density and surface hardness for practical industrially acceptable products. Further, axial depths greater than about 2 or 3 inches would require compression molding machines which apply excessively greater pressure and at some point are impractical for this use.

It should be noted that the abrasive molding compositions used typically are a mixture of relatively fine powder size components. The object of the process is to reduce the porosity of the final compacted and molded product to as close to zero as feasible. However, the fine powder component mixture represents solids during the initial compaction. The binder component eventually becomes somewhat viscous or semi-solid during the heating and pressing cycle in order to wet and bond the remaining solid particles in a strong, dense final product.

The filler and abrasive particles have limited flow properties within the mold cavity even under high pressure. Therefore, in the conventional axially directed pressing method, the axial length of the composition in the mold tends to be limited to between the 1 to 2 inches noted to obtain a practical industrially accepted final product. The use of press platens having inflexible surfaces tends to limit the uniformity of density and surface hardness achieved even in non-annular shapes such as in laps and similar abrasive tools.

It should be noted that once the annular abrasive molding composition is processed, the interior volume is filled with a suitable core material. Often the core is a plastic material which is bonded to the inner surface of the abrasive layer ring-shaped configuration and completes the grinding wheel tool.

Prior to the present invention, significant improvement of compression molding of annular shapes of abrasive products, such as described, has eluded those skilled in the art.

BRIEF SUMMARY OF THE INVENTION

The present invention relates to the making of compression molded abrasive products and is particularly useful for those having annular, cylindrical or various lap configurations, an apparatus for practicing this method, and a novel product made possible using such method and apparatus.

Such annular-shaped products include grinding wheels, mandrels or generally similar shapes wherein the outer surface comprises an annular molded layer of a resin, metal or ceramic bonding composition including filler and abrasive particles distributed throughout the composition. Various filler materials and binding material compositions are well-known to those skilled in the art.

A preferred compression molding apparatus for practicing the method of the present invention comprises an annular housing, an annular inner wall fixed within the annular housing, and an annular flexible sleeve forming an annular wall disposed adjacent to the outer surface of the inner annular wall to form a sealable pressure chamber. An annular mold space or cavity is defined between the outside surface of the flexible sleeve and the inside surface of another fixed annular wall. The latter may be formed either by the inside surface of the annular housing or more preferred, the inner surface of a removably fixed annular insert adjacent to the inner surface of the annular housing.

In a preferred embodiment, a plurality of fluid ports are provided which communicate fluid to the sealed pressure chamber formed between the fixed inner annular wall and the flexible wall. This pressure forces the flexible wall to expand into radial directed, force-transmitting engagement with a molding composition disposed within the mold space. The expansion of the flexible wall exerts a highly uniform pressure force to a molding composition disposed within the annular mold space.

Appropriate heating means are provided to transmit heat to a molding composition disposed within the mold space while compression forces are applied to the molding composition as described above.

Removable top and bottom covers may be employed to advantageously permit assembly and disassembly of the components for access to the mold space and removal of the final molded product.

In one preferred embodiment, the process of the present invention generally relates to providing a sealable annular mold space filled with a molding composition defined between a first fixed annular wall and a flexible annular wall having one surface disposed adjacent to a second fixed annular wall thereby forming a sealed, fluid pressure chamber between the flexible wall and the second fixed wall. A selected fluid pressure source is communicated to the pressure chamber to cause the flexible wall to expand toward the mold space and apply uniform radially directed pressure to the mold composition in the mold space. Applying heat to the molding composition while applying the pressure forces via the flexible wall causes the powdered components in the molding composition to form a solid configuration conforming to the shape of the mold space.

In another preferred embodiment, the mold space and pressure chamber may be formed in a linear or non-annular configuration. The use of a flexible wall to apply pressure to a confined volume of the molding composition has an advantageous effect upon the abrasive mold composition in powdered form with respect to applying a more uniform pressure throughout the thickness dimension of the mold composition. This tends to improve the uniformity of the density and resulting surface hardness of the final molded product compared to prior art methods and means, as well as doing so at lower capital costs.

As one aspect of the present invention, the apparatus and method provide an improved process for making superabrasive impregnated tooling, reducing capital costs of the pressing and molding equipment, labor and cycle time for making the product. Generally speaking, prior presses and molds employed in making such tools often cost substantially more than a compression molding apparatus of the present invention for making a final product of similar dimensions.

It is another aspect of the present invention to manufacture abrasive tools, such as centerless grinding wheels, having a much greater axial dimension relative to the radial depth of the abrasive layer to form an integral, uniform construction in a single molding cycle compared to using prior and present methods and apparatus.

It is a further aspect of the present invention to provide an apparatus and method of the type described which provides great flexibility of final product size and the ability to more easily and inexpensively form complex shaped, grinding surfaces compared to prior methods and means using the molding apparatus of the present invention readily modified in a simple manner.

It is another object of the present invention to produce molded, annular abrasive shapes using thermoplastic resins as well as thermoset resins using the same form of pressing apparatus.

As yet a further aspect of the present invention, the method and apparatus of the present invention is also applicable to planar shapes, such as abrasive surface lap which may have planar, concave, convex or grooves or the like, in view of the improved uniformity of the density and resulting uniform surface hardness of the molded abrasive layer.

BRIEF DESCRIPTION OF THE SEVERAL VIEWS OF THE DRAWINGS

FIGS. 4, 5-A and 5-B are sectional side elevational views similar to the views in FIGS. 1-3, illustrating further embodiments of the present invention;

Figure 1:
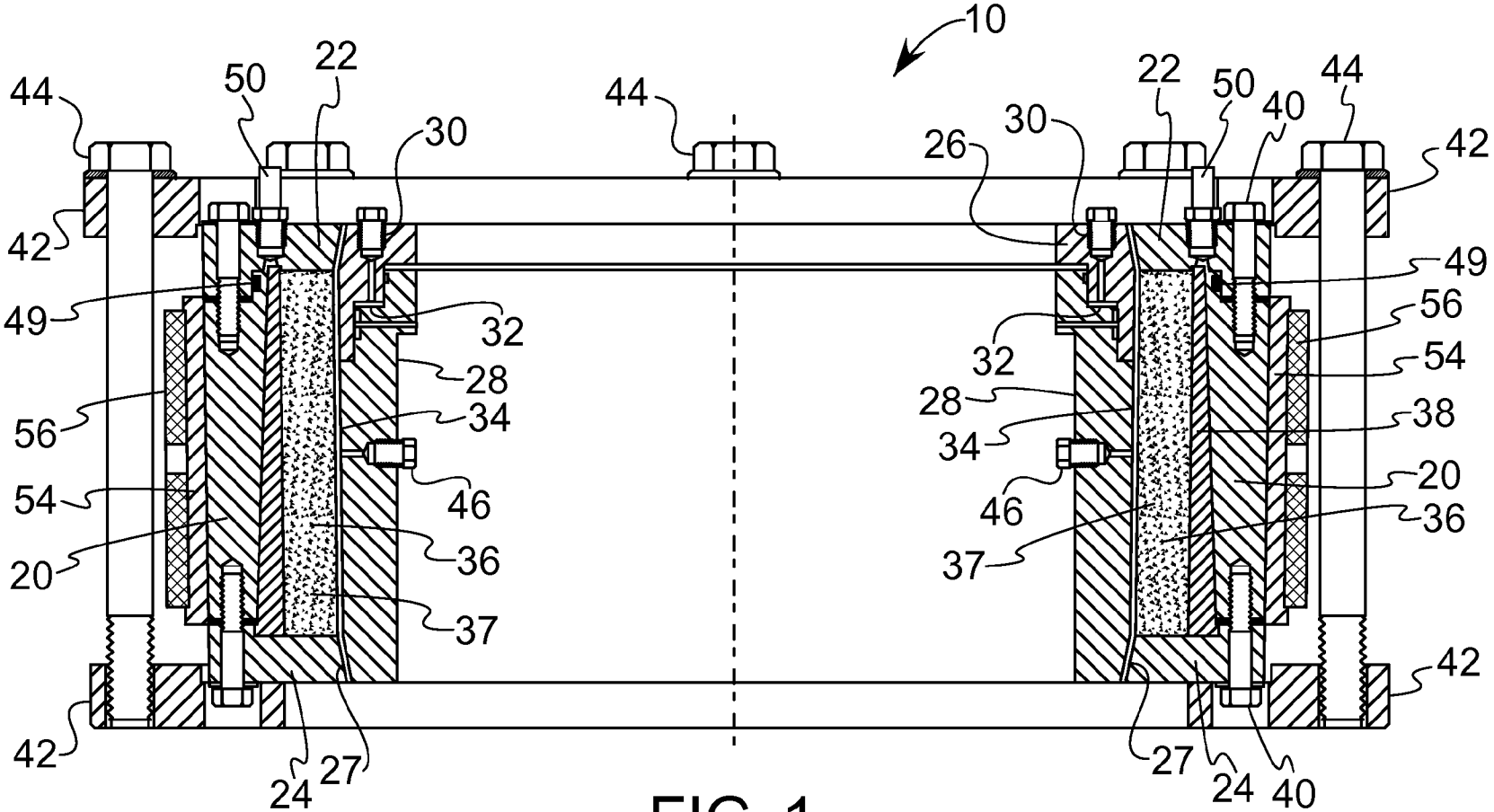
FIG. 1 is a sectional side elevational view, the section being taken along line 1-1 in FIG. 8.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

Referring to FIG. 1, a preferred embodiment of an apparatus in the manufacture of molded abrasive impregnated tools, such as centerless grinding wheels, constructed in accordance with the present invention is shown and indicated generally at 10. Apparatus 10 includes an outer annular housing 20, a top cover 22 and bottom cover 24 forming top and bottom walls. A removably mounted inner cylindrical wall is provided and preferably comprises an annular upper part 26 and a mating annular lower part 28.

Preferably, the housing 20, top and bottom covers 22 and 24 and inner cylindrical parts 26 and 28 are made of high quality alloyed steel.

The cylindrical parts 26 and 28 mate with a tapered opening portion, such as at 27, of top and bottom covers 22 and 24 respectively, which fix the radial position of each part. Fluid pressure ports 30 provided in cylindrical part 26 communicate with a narrow gap 32 between cylindrical parts 26 and 28. Gap 32 is sealable via conventional gaskets or o-rings.

Figure 6:
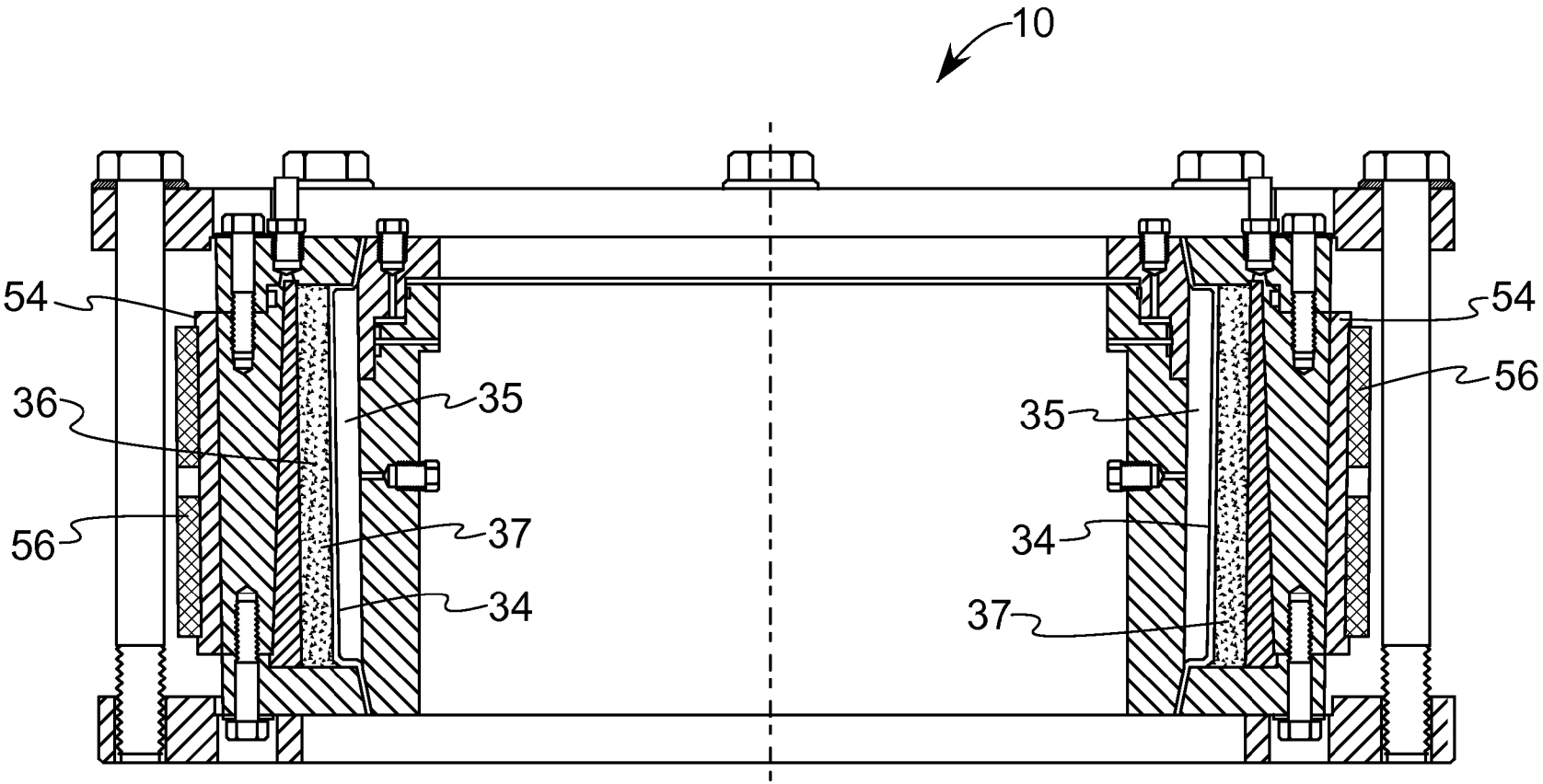
FIG. 6 is a sectional side view shown in FIG. 1, illustrating the flexible wall of the pressing apparatus in an expanded condition.

An annular sleeve 34 comprising a flexible material is disposed adjacent to the outer surface of cylindrical parts 26 and 28 and includes an upper and lower portion abutting a portion of top and bottom covers 22 and 24 to form the expandable wall of a pressure chamber 35, best seen in FIG. 6, between the outer surfaces of cylindrical parts 26, 28 and the inner surface of sleeve 34. The sleeve 34 also forms one wall of a mold space 36.

Upon applying fluid pressure to port 30, sleeve 34 is forced into a sealed relationship between tapered portions of cylindrical parts 26, 28 and the tapered sections 27 of top and bottom covers 22 and 24. The outer fixed wall defining the mold space 36 is preferably formed by an annular insert 38 disposed in removably fixed relationship against the inner wall of outer housing 20 and top and bottom covers 22, 24 as will be described in detail later below. The top and bottom opening of mold space 36 is closed by top and bottom covers 22 and 24.

Preferably insert 38 is made of bronze or other metal having high rates of heat transfer. The outer wall of insert 38 is preferably tapered and mates with a taper provided on the inner wall of housing 20 to aid in the removal of the final molded product upon removing one or both covers 22 or 24. The latter are bolted or otherwise conventionally removably connected to housing 20 via a plurality of bolts, such as at 40.

As seen in FIG. 1, optional top and bottom annular safety collars 42 are disposed in surrounding engagement to top and bottom covers 22 and 24 and bolted together, such as by bolts 44, to enhance safety in view of the pressure being applied during the molding process.

Pressure ports, such as 46, are provided in spaced relationship through the wall of lower cylindrical part 28 for communication of fluid pressure from a conventional source of pressure to the closed space or sealed volume forming pressure chamber 35 (see FIG. 6) between the adjacent surfaces of cylindrical parts 26, 28 and the intermediate portion of flexible sleeve 34. The pressure applied in chamber 35 is then exerted, via the expanding flexible sleeve 34, to the mold space 36 which may be loaded with an abrasive molding composition indicated at 37.

The type and nature of the conventional abrasive impregnated mold composition used for such molded tooling is well-known to those skilled in the art. Such compositions typically include powdered fillers, binders and abrasive, preferably super abrasive, particles. Most tooling of this type is made using resin binders and specifically thermoset resin powders. Such molded compositions, under heat and pressure, are compressed and solidified to form a grinding surface which is dense and relatively hard. Therefore, proper dimensioning of the final molded product profile close to the required specifications of the end user is desirable to reduce the machining of the final product which may be necessary to meet product specifications of a given application.

Typically, the conventional processes presently used in making such abrasive molded resin, metal, or ceramic bonding compositions require large hydraulic presses moving steel platens or annular plungers to apply pressures from about 1,000 to 10,000 psi or higher to the abrasive mix. Temperatures employed are in the range of about 300 to 800 degrees F. for resin compositions and higher for metal or ceramic binders. During the molding process, the original volume of the composition as loaded into mold space 36 may be reduced by a factor of 2 to 5 relative to its original dimensions. Such conventional compression molding presses and annular steel molds used to create an annular shaped abrasive composition layer apply pressure in an axial direction relative to the annular mold space. This process has been in use for many decades, despite the significant limitations relative to the practical length in an axial direction which may be achieved. This axial length dimension defines the width of the annular grinding tool surface for performing useful work while rotating the grinding wheel about its axis. Therefore to make grinding wheels of greater than a few inches, several separately molded annular components must be stacked and adhesively mounted to one another.

Referring to FIG. 6, flexible sleeve 34 is shown disposed in an expanded condition which has caused mold space 36 and abrasive molding composition 37 to be compressed into a smaller volume than the initial mold space shown in FIG. 1.

A source of pressurized fluid, preferably in a gaseous form, not shown, may be conventionally connected to pressure ports 30 and 46 to supply the level of pressure desired. Preferably, an inert gas such as nitrogen is used, however, the present invention is not limited to the gas or fluid employed other than for cost or other practical characteristics.

In a more preferred embodiment, a plurality of vacuum ports 50 provided in top cover 22 are employed. These ports 50 communicate with the mold space 36 retaining the abrasive molding composition via a very close, but gas pervious clearance fit between the lower surface of top cover 22 and the adjacent upper edge of annular insert 38. The tolerance of this close clearance fit is designed to permit air and any gases initially contained within or developed during the curing process to be evacuated from the molding space. However, the close fit will eliminate or significantly reduce any loss of the powdered components of the abrasive molding composition from mold space 36 upon application of a vacuum and during the subsequent application of pressure. A conventional gasket or o-ring, such as at 49, may be used to seal the joinder between top cover 22 and housing 20.

Preferably, the level of vacuum applied is in the range of $10^{-2}$ to $10^{-3}$ torr, however, this may vary considerably depending upon the abrasive molding composition employed and the characteristics desired in the final product. Typically it is desirable to remove air trapped within the abrasive molding composition after initial loading into the mold space 36. However, this may be accomplished in different manners and application of a vacuum as described herein is believed to be highly preferable during the process of the present invention, but not essential to obtain other advantages provided by the present invention. However, use of a vacuum as described also aids in removal of gases formed during the curing of resin binders typically used and tends to improve the bond formed. It is believed such use of a vacuum also tends to reduce the level of pressure necessary to achieve a more uniform and denser final product.

In the preferred embodiment described, an annular aluminum ring 54 is provided in surrounding relationship to outer housing 20 and an annular electric heating element 56 of conventional construction is disposed in surrounding relationship to ring 54. The aluminum ring 54, as well as the bronze insert 38, are preferred materials to improve the uniformity and efficiency of heat transfer to the mold space 36 and the composition disposed therein. Other suitable arrangements for heating the mold space 36 may be used without departing from the spirit of the present invention.

Figure 8:
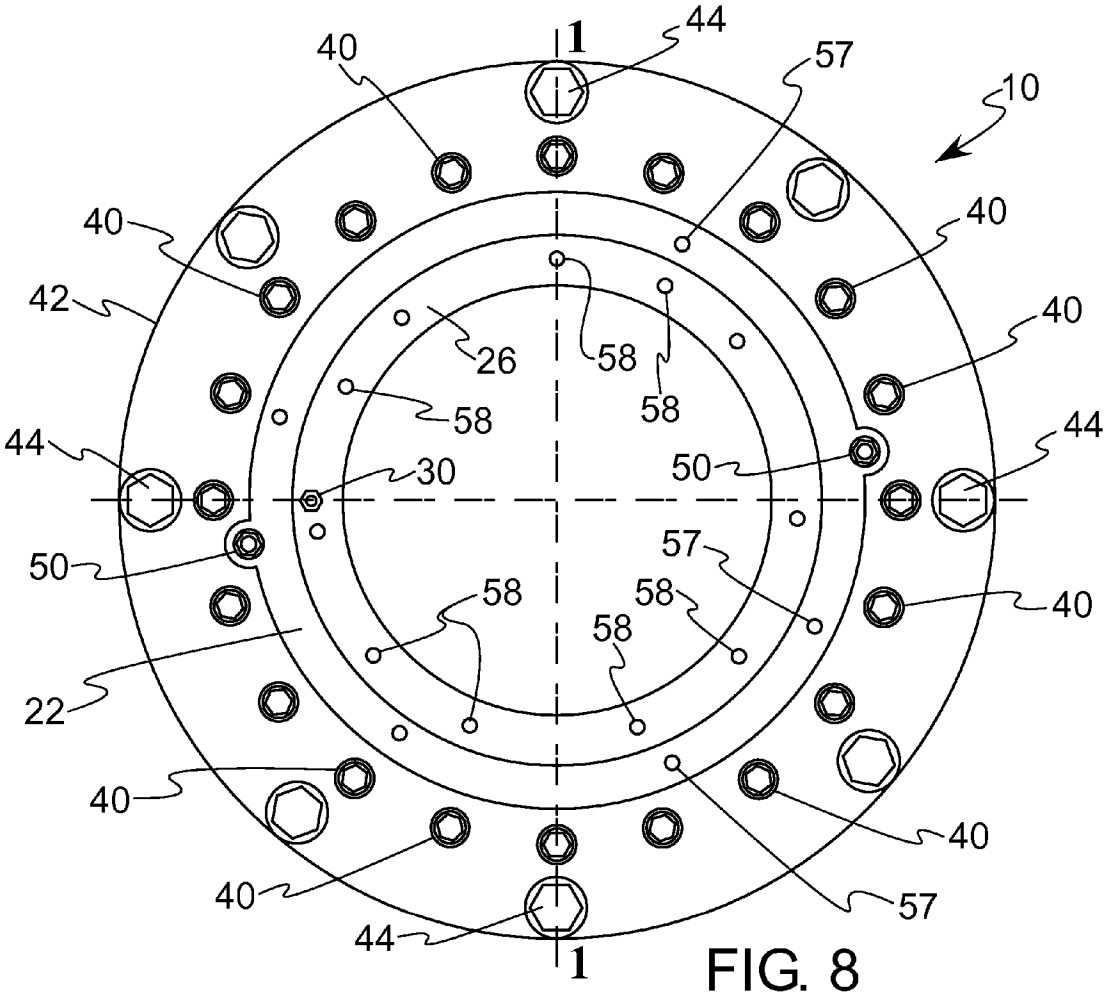
FIG. 8 is a top plan view of the apparatus shown in FIGS. 1-5.

To remove top cover 22 from the assembled pressing apparatus, the upper safety collar 42 is removed by removing bolts 44. Upon removing bolts 40, top cover 22 may be lifted free of the housing 20. As best seen in FIG. 8, a plurality of threaded eye bolts, such as at 57, are provided in the upper surface of top cover 22 and at 58 in upper and lower cylindrical parts 26, 28 to permit easier removal of cover 22 and upper and lower cylindrical parts 26, 28. This facilitates removal of the final molded product or re-assembling the pressing apparatus 10 after loading an abrasive composition in mold space 36.

Figure 7:
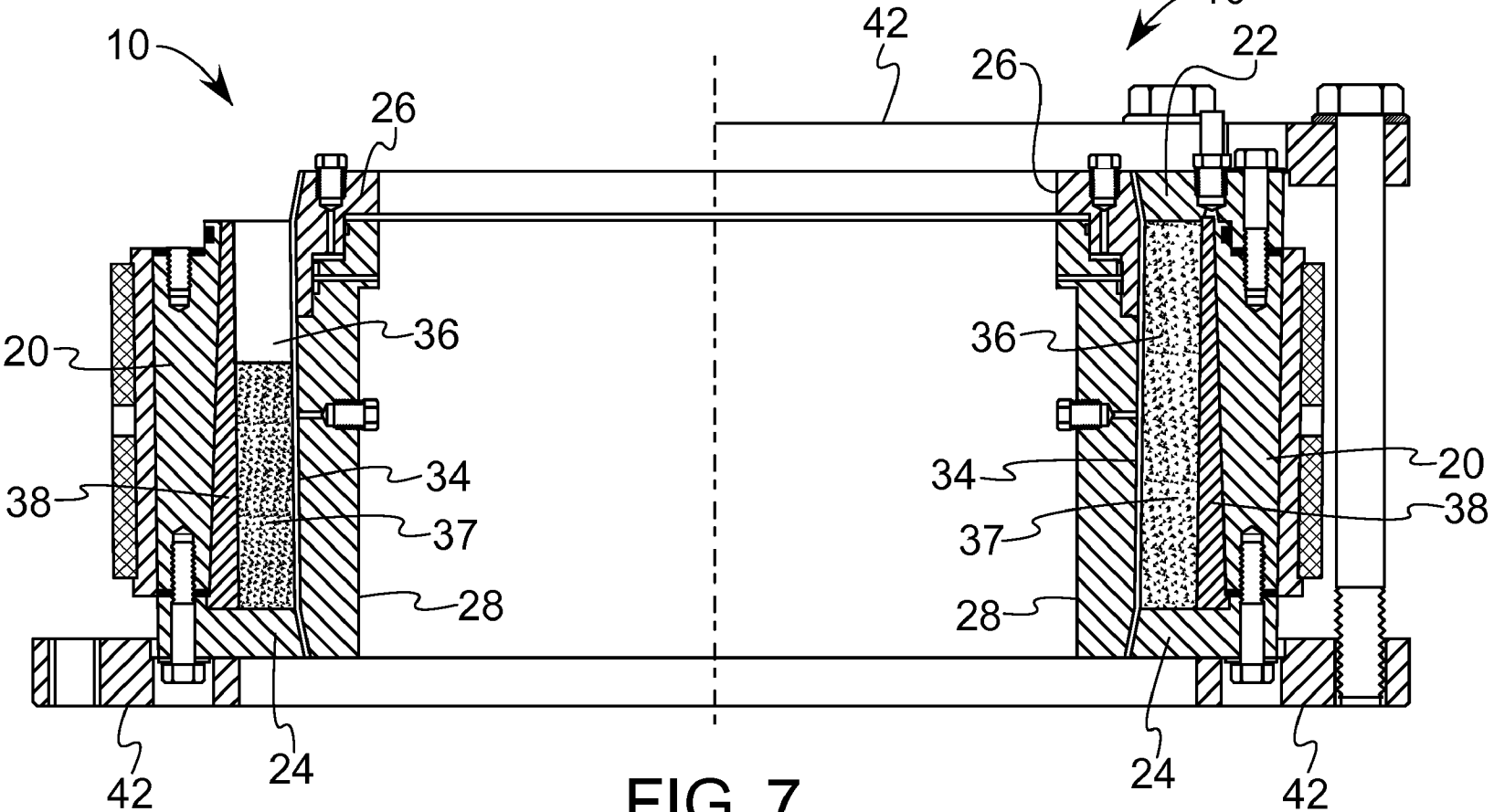
FIG. 7 is a split sectional side view of an apparatus constructed in accordance with the present invention similar to that shown in FIG. 1 with one-half of the apparatus being shown with certain parts disassembled to illustrate a loading condition.

As best seen in the split view of FIG. 7, the left side illustrates top cover 22 and safety collar 42 removed which exposes the mold space 36 so it may be initially filled with the powdered abrasive molding composition 37. It shows mold space 36 partially filled with composition 37. The right side of FIG. 7, illustrates the cover 22 and safety collar 42 in fully assembled condition with the mold space 36 fully loaded with composition 37 similar to FIG. 1.

An appropriate opening in the top of cover 22 is provided for a conventional bushing for vacuum pressure port 50 and a similar opening and bushing is provided in the top wall of upper cylinder part 26 for pressure port 30.

It should be noted that in accordance with the present invention, annular abrasive tooling shapes, such as integrally formed grinding wheels, can be efficiently and readily produced in a single molding cycle having dimensions, such as for example, 36 inches in diameter and 24 inches or greater of axial length. Further, such a long axial length can be readily cut along its axis into several parts such that a plurality of shorter axial length wheels can be formed in one molding operation. Water jet cutting would be one preferable choice to make such cuts. The abrasive outer layer may conveniently be made with a radial width from ⅛ to about 2 inches with excellent uniform properties throughout the composition and highly uniform density as measured by the surface hardness.

Prior to the present invention, a grinding wheel of this size was formed by separately molding and then adhesively joining a plurality of 36 inch diameter by 1 to 2 inch axial length parts together to obtain a grinding wheel having a width in the axial direction of about 24 inches. The total manufacturing time to make such a grinding wheel using the prior art method can be as much as ten times greater than the total cycle time employing the present invention for making a similar product in one molding cycle.

Further, the application of pressure in the radial direction using a fluid impervious, flexible sleeve, such as described herein, allows great flexibility in the configuration which may be formed, reduces cost in labor, cycle time and other associated costs of processing.

Using the compression molding and method of the present invention has been found to require levels of applied pressure to achieve similar densities of the same molded abrasive compositions on an order of one-half or less than those required in comparable prior art processes.

In view of the novel application of pressure to an annular mold configuration in accordance with the present invention, the compression is achieved through the short material depth in a radial direction compared to the axial length. This is very different relative to prior conventional processes of this nature using axially directed pressure for making the annular components used for abrasive grinding wheels or similar shapes. According to the present invention, pressure is applied via an expandable, flexible membrane which tends to compress the yieldable abrasive molding composition more uniformly throughout the radial depth of the abrasive composition. This feature provides an end product having at least an equal, and it is believed a better quality, relative to uniformity of density and surface hardness of the final form of the composition compared to the prior art. As noted above, it also permits the use of significantly lower pressures to achieve at least equal density and surface hardness for the same or similar molding compositions made using the conventional prior art processes for molding abrasive composition layers.

An example of making a large grinding wheel using the apparatus and method of the present invention is described below.

Example 1

Diamond nickel coated powder 270/325 mesh (34.1%) is combined with a binder, phenolic novolac resin (20.64%), and filler material comprising a mix of abrasive and mineral powders (45.26%). Unless stated otherwise, the percentages herein are in weight percent. The choice of diamond is dictated by the application. Cubic boron nitride and other superabrasives or hard abrasive materials could be used. As a binder, the phenolic novolac resin for grinding carbides is a preferred, but not the only choice. The cross-linked plastics, such as resole and cyanate phenolic, melamine-formaldehyde, epoxy, acrylic, bismaleimide, and others could be used for certain applications. Thermoplastic materials like polyimides, for example, could be also used. It is common for carbide grinding applications to use abrasive powders like silicon carbide or aluminum oxide for filler materials, for example. Such powders could be combined with minerals such as Novaculite or Wollastkup or mixes of such materials. Metal powders like iron, nickel, and copper are a choice for special application. The weight proportion cited above is for a particular industrial application. Other formulations could be used depending upon the desired properties as is well-known to those skilled in this art.

The components of the abrasive molding composition 37 may be blended together in a Turbula or other rotating mixer. The mixing time should be sufficient to get the components as evenly distributed as feasible in the mix. Other procedures to prepare the composition mixture could be used including, but not limited to, granulation, peletizing, and wet mixing as well-known in the art.

The abrasive molding composition 37 is then loaded in the device as shown in the left side of FIG. 7. The bottom cover 24, tapered insert 38, sleeve 34 were assembled with inside cylindrical parts 26 and 28 to form pressure chamber 35, as earlier described. Prior to loading the composition 37 in mold space 36, the surfaces of apparatus 10 that come in contact with the abrasive composition during pressing are treated with a conventional release agent to prevent sticking of the pressed material to such surfaces. After the composition 37 is loaded, the top cover 22 is assembled with the outside housing 20 to close the pressure chamber 35 and mold space 36. The abutting surfaces of the outside housing 20, top cover 22 and bottom cover 24 are sealed with conventional gaskets or o-rings.

The composition loaded in the mold space 36 is porous. The initial porosity may be as high as 75% of the volume. During the compression molding cycle, the porosity changes and eventually approaches 0%. The cycle starts with applying gas pressure to port 30. This pressure seals the top and bottom portion of the sleeve 34 between the top and bottom covers 22, 24 and cylinder parts 26, 28. A vacuum pump, not shown, is connected to the vacuum ports 50 and begins to evacuate air from the composition 37. This also provides initial reduction in the volume of the composition 37. After the vacuum pressure in the mold space 35 reaches approximately about $10^{-2}$ torr, the pressure chamber 35 between the inside cylindrical parts 26, 28 and sleeve 34 is pressurized with nitrogen via port 46 conventionally connected to a conventional source of pressurized nitrogen. Nitrogen is a preferred choice as an inert and low cost gas. Other gases and mixes of gases, including air could be used in the process. The gas pressure causes sleeve 34 to expand and compress the composition 37 in the mold space 36. The pressure is slowly raised while compacting the composition 37. For the described sample, once the designed upper pressure level applied is achieved, the vacuum and pressure are automatically kept the same through the remaining compressing cycle. It is important that the pressure is applied through a flexible sleeve 34. When expanded by the gas pressure, sleeve 34 provides unique, very uniform pressure throughout the composition 37 as it conforms to any relatively minor variances in the homogeneity of the abrasive composition mixture. Under such highly uniform application of pressure, the composition is more evenly compressed in the radial direction to approach a more uniform density as exhibited by surface hardness with very little deviation. The upper pressure applied in this example was 200 psi. Other higher or lower levels of pressure depending upon the materials of the bonding composition could be used.

Figure 10:
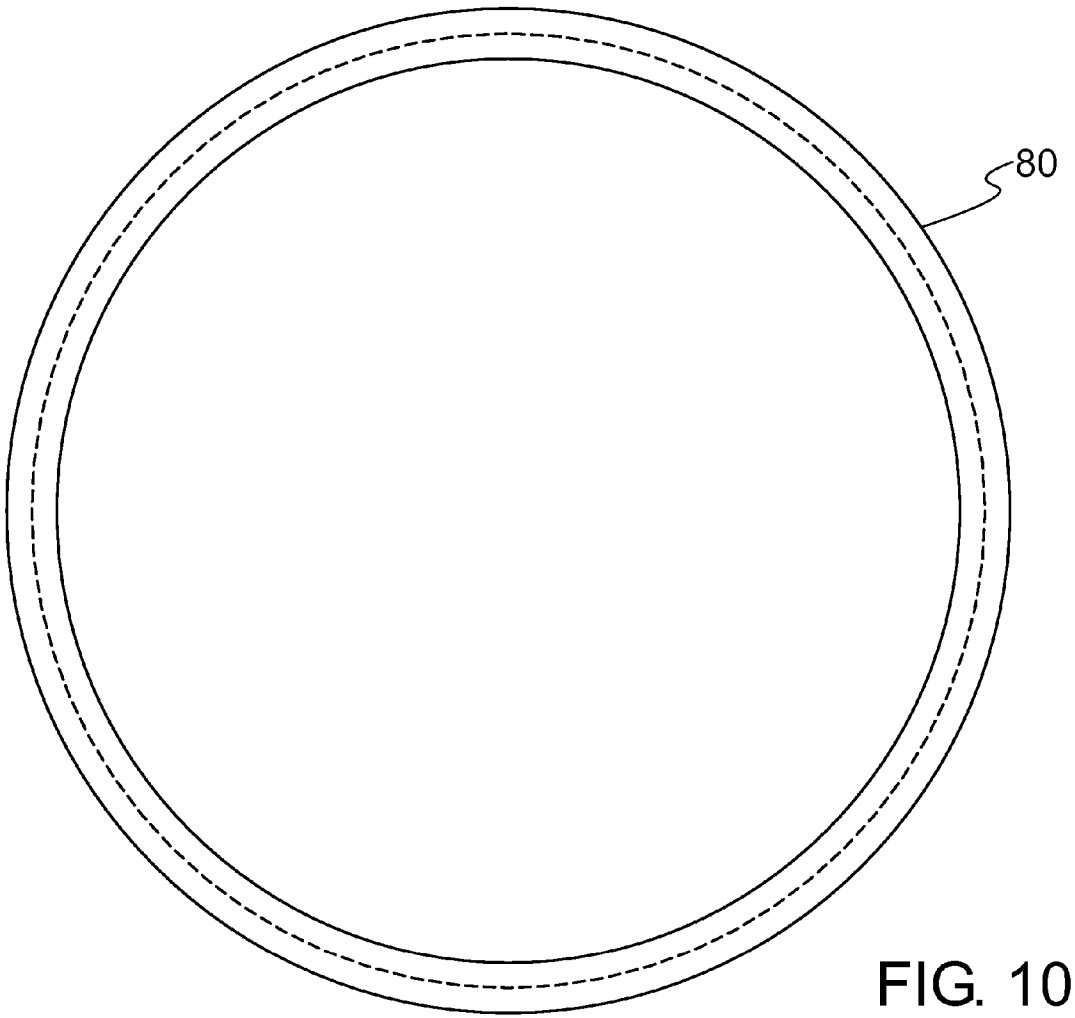
FIG. 10 is a top plan view of an annular abrasive composition ring segment made using the apparatus shown in FIG. 1.
Figure 11:
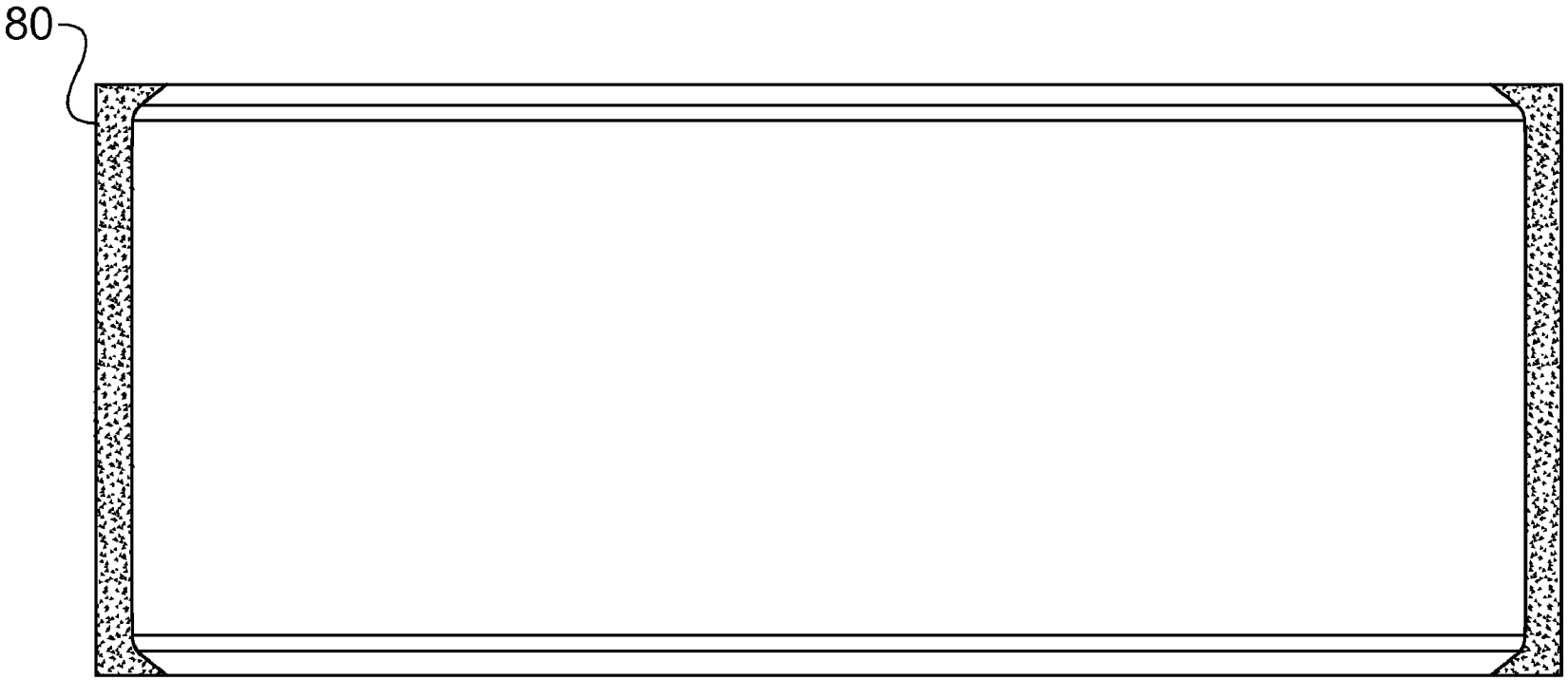
FIG. 11 is a side sectional view of the ring segment shown in FIG. 10, the section taken along a centerline through the segment shown in FIG. 10.

After 5-10 minutes of applying 200 psi pressure and the $10^{-2}$ torr vacuum, the heating of the composition was begun. The upper temperature applied depends upon the type of binder. For phenolic novolac resin, 350 to 370 degrees F. is recommended. For the described procedure of making a wheel having the dimensions of 8 inch diameter, 8 inch in axial length and 0.5 inches in the radial depth of the abrasive layer, the temperature was set to 350 degrees F. Heating proceeded slowly and in about one hour and a half the abrasive composition went from room temperature to 350 degrees F. After the temperature reached 350 degrees F., it was held constant during the process. The time may vary, however, it should be sufficient to ensure a full curing cycle of the resin binder employed. In the described sample, it was set to 30 minutes. During the heating cycle, the binder undergoes a conventional cross-linking reaction. The phenolic resin particles soften and fuse, then for a short time became melted, gelled and eventually cross-linked. The process of cross-linking is a complicated event. There are deep changes that could be compared to changes in state of matter, for example, from solid particulate to porous, then to elastic, liquid and in the final product to a solid. Heat and cross-linking agents initiate the chemical reaction of novolac phenolic resin. It is carried out with releasing water vapor and ammonia. These gaseous byproducts preferably should be evacuated from the mold space 36. This removal of gases tends to insure a higher quality of the final composite product where solid particles of diamond and filler are embedded in a dense, continuous, high molecular, weight-cured resin network. After uniform processing in the cycle at the upper temperature and pressure, the molded annular ring is cooled and removed from the apparatus. The final abrasive layer 80 with the annular ring shape shown in FIGS. 10 and 11 is conventionally assembled with a suitable core material and then is ready for final machining to the required dimensions of the application in a conventional manner. Any deviations in the opposing interior surface of ring 80 formed adjacent to sleeve 34 may be cut using conventional water jet techniques and/or grinding to make the opposing major surfaces satisfactorily parallel to one another as may be required.

It is common in the industry to use the surface hardness of the abrasive layer as the main characteristic of wheel quality along with dimensional stability. The hardness and the dimensions of the 8"OD×8.290" H×0.5" T wheel made in the above example were taken at several locations with the following results.

Hardness:
average HRH 117
maximum HRH 117
minimum HRH 116
Outside Diameter:
average 8.041 inches;
maximum 8.043 inches;
minimum 8.039 inches
Length:
average 8.3046;
maximum 8.306;
minimum 8.303

The assembled wheel passed the conventional safety test at 5000 rpm for 5 minutes. The above values indicate high uniformity and good dimensional reliability.

Example 2

Metal Bond Composition

A wheel for grinding ceramic or glass could be made in the present invention using 54.93% of copper (−325 mesh), 13.73% of tin (−325 mesh, combined with 26.5% of nickel (−325 mesh), 3% of silver (1-5 microns) and 1.84% of TiH2 (1-3 microns). This combination is mixed dry in a Turbula for three hours. This composition is combined with 19.5% by volume of diamond powder (60-40 micron) and mixed one hour wet with 0.3% alcohol/glycerol (80/20%) to prevent segregation. The prepared mixture is loaded in mold space 36. After loading, pressure chamber 35 is sealed as previously described. By the same means as in Example 1, air is evacuated from the mold space 36. A pressure up to 1,000 psi is applied to sleeve 34 and the heating starts. It is known that tin particles melt at 450 degrees F. Under pressure, melted tin is forced into the interstices between other particles of the composition and diamond. Melted tin contacts the surface of copper particles and diffuses in it creating an alloy. During this time, the composition is initially compressed. Further heating to 600 degrees F. and applying pressure and vacuum result in full densification of the material due to stress deformation and creep. No leakage of solids from the mold space 36 is expected and the composition will essentially stay intact during the process cycle. The pressure is uniformly applied to the composition via the flexible sleeve 34 which results in evenly distributed, highly uniform density. After removal of the final annular ring product, it is conventionally mounted on a core, machined and inspected in a conventional manner.

It should be noted that upon removal of top cover 22, bottom cover 24 and cylindrical parts 26, 28, the molded product is removed with sleeve 34 and the tapered insert 38. The taper on annular insert 38 facilitates its removal and the removal of the molded product from apparatus 10.

Example 3

Ceramic Vitrified Glass Based Composition

In some applications, vitrified bonds with extremely high modulus of elasticity are preferable. For instance, the centerless grinding of steel ball bearing parts is based on using large axial lengths of superabrasive cubic boron nitride (CBN) vitrified segmented cylindrical wheels up to 20 inches in diameter. The prior art of making such segmented grinding wheels is well-known. It includes preparing the mix of components, cold compression in the steel mold, removing the cold pressed mixture from the mold and firing at temperatures up to 1500 degrees F. Finally, after cooling, each segment is glued together with a core. Free firing of cold pressed segments without a mold subjects the product to the irregular changes in size, shape, and porosity of composition. Stress related cracks could happen at and after firing and specifically in the process of cooling and removal. The manufacture of this type of CBN segmented ceramic bonded wheels by prior known processes is a costly and complicated process.

The procedure of making ceramic, vitrified bond according to the present invention could be used for manufacturing the described type of wheels more effectively. Annular rings of large size and with thin walls could be pressed in the apparatus 10 described herein. There are low temperature vitreous sealing glasses that soften at less than 600 degrees F. For example, Ferro Co. commercially sells sealing glasses capable of binding CBN particles and suitable filler materials. By viscous flow under pressure the particles of glass become fused and create a continuous material bonding the particles of CBN and filler particles together after cooling. Bismuth oxide based compositions also could be used.

For example, a mixture is prepared from the low temperature sealing glass EG2012, commercially available from Ferro Co. (54.47%), combined with graphite powder (9.26%), and Boron Nitride HCP powder (1.45%), and 230/270 mesh CBN Type 1 from Diamond Innovation, Inc. (34.82%). The mix is loaded in the mold space 36 as described herein. After loading, the pressure chamber 35 and mold space 36 are sealed in the same way as described in Example 1. Upon evacuating air as described, a pressure of up to 1,000 psi would be applied to pressure chamber 35. The sleeve 34 expands and transfers the pressure to ceramic composition 37. When heated to 700 degrees F., the particles of sealing glass will become softened and flow under pressure and are distributed throughout the composition 37. This densifies the composition in mold space 36. The time of heating and pressure processing should be substantial to insure the full densification of the material, at least 1½ to 3 hours. After cooling, the ring-shaped product could be removed, connected to a core, machined and used for grinding in a conventional manner. Since sleeve 34 is flexible, there are no cracks formed during the cooling and removal of large volume pressed parts, such as rings for centerless wheels, which often occur in the prior art processing of ceramic binder abrasive compositions.

Further, it should be pointed out that in the more preferred embodiments, the use of vacuum pressures applied as described to the volume of the abrasive molding composition is desirable to aid in removing air entrapped within the composition mixture and any gaseous side products produced during the compacting, heating and from chemical reactions occurring during the process. This tends to improve uniformity of the density and quality of bonding the diamonds within the matrix in the final product.

The flexible, expandable and essentially gas impervious material useful for sleeve 34 may comprise plastic elastomers, such as polysiloxane cross-linked with an organic peroxide. Red iron oxide formulations with a durometer hardness of 50-60 could also be used. The plastic elastomers include those which may be readily used at pressures up to about 2,000 psi and temperatures up to about 800 degrees F. Iron oxide formulations withstand the pressure ranges useful with many abrasive compositions often used in the described examples herein up to 2,000 psi and at temperatures near about 600 degrees F. Further, they are flexible, providing an elongation of about 500 percent.

Other elastomers such as flurosilicons and fluorocarbons are suitable for higher temperature applications, if required. Many other materials may be used which meet the required characteristics of gas imperviousness, expandable flexibility, strength and resistance to the required temperature for a given composition.

If a reinforced flexible and resilient material is employed, the sleeve 34 may be reused instead of being replaced after each compacting and molding process is complete. This may be desirable, but it is not necessary to advantageously employ the teachings of the present invention.

Figure 2:
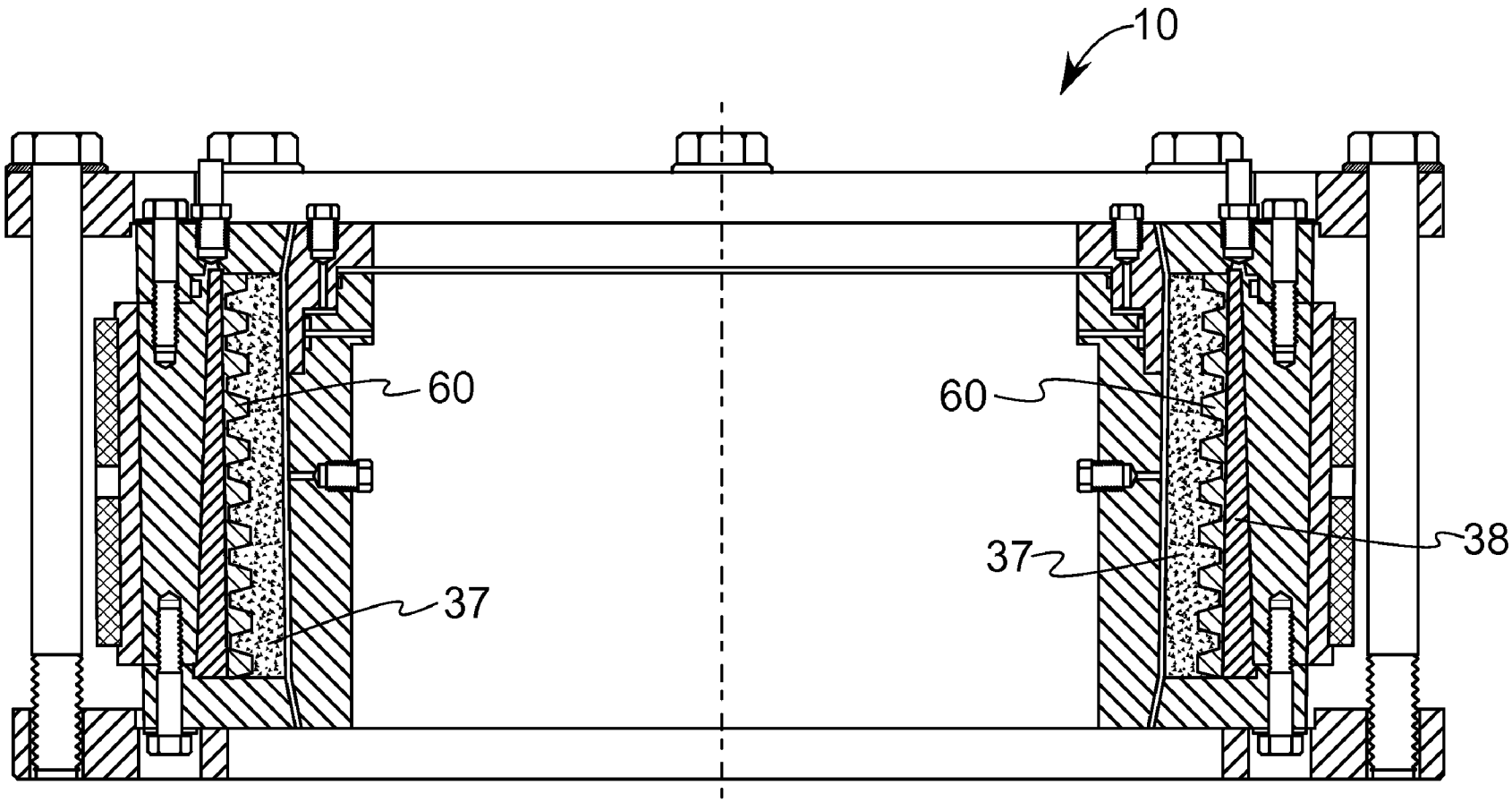
FIG. 2 is a sectional side elevational view of another embodiment of the present invention, the section being taken along line 1-1 in FIG. 8.

Now referring to another embodiment shown in FIG. 2, an apparatus constructed the same as that shown in FIG. 1 is illustrated. The only difference is the addition of a metallic insert 60 having a worm gear grinding wheel configuration facing inwardly toward the mold space. Preferably, insert 60 comprises aluminum in view of the ease of machining the desired shape imparted to the outside, working surface of the molded annular part. In FIG. 2, the insert 60 permits creation of an annular gear tooth grinder in the same manner and using the same process previously described. After the removably mounted insert is disposed in a removably fixed position abutting insert 38, as shown in FIG. 2, the abrasive mold composition 37 is loaded into the now modified mold space and the process is followed as previously described.

Figure 3:
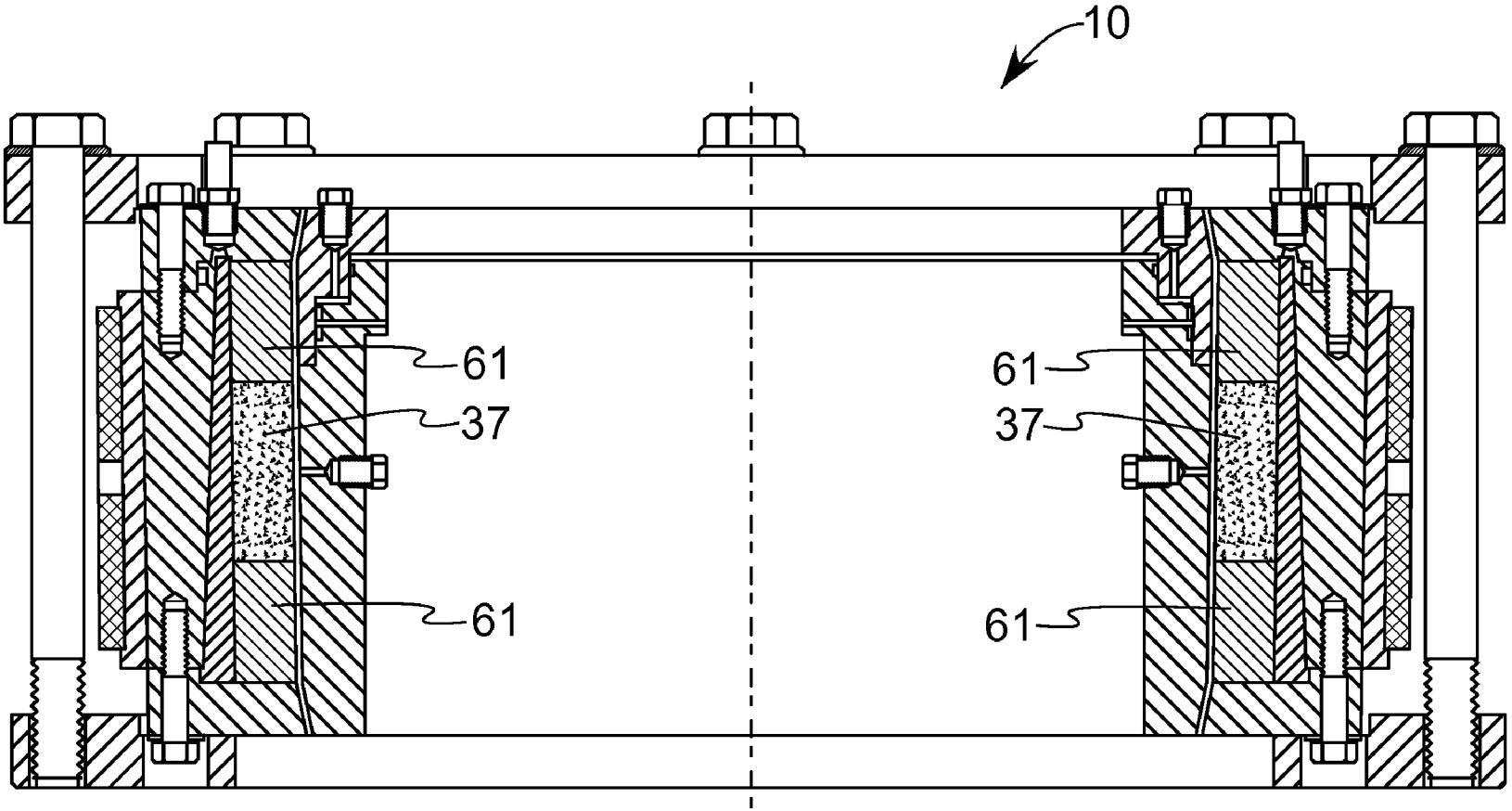
FIG. 3 is a sectional side elevational view of another embodiment of the present invention, the section having taken along line 1-1 in FIG. 8.

Other embodiments of the present invention utilizing inexpensive and removably mounted inserts to modify the volume of mold space 36 or shape of the mold space 36 are shown in FIGS. 3, 5-A and 5-B.

In FIG. 3, a pair of inserts 61 are used to merely create an annular compacted, molded abrasive shape of smaller axial length using the same dimensions of the apparatus 10 as described in FIG. 1. FIGS. 5-A and 5-B illustrate how to make an annular grinding wheel abrasive layer having two spiral strips comprising different abrasive molding compositions pressed together as opposed to cylindrically disposed layers of different abrasive molding compositions which is illustrated in FIG. 4.

In FIGS. 5-A and 5-B, a spiral shaped insert 62, having a screw thread surface, is placed within the mold space 36 and a given abrasive composition 64 is loaded in the remaining mold volume and processed as described earlier herein. Upon finishing the process, the first molded composition and solid insert are removed. Then the finished molded composition 64 is placed in the mold space and functions as an insert, allowing the addition of a different abrasive composition 66 to be loaded and processed in the same manner as previously described to provide the final molded product having spiral strips comprising two different abrasive compositions. In each molding cycle, the process employed is the same as previously described herein.

Figure 4:
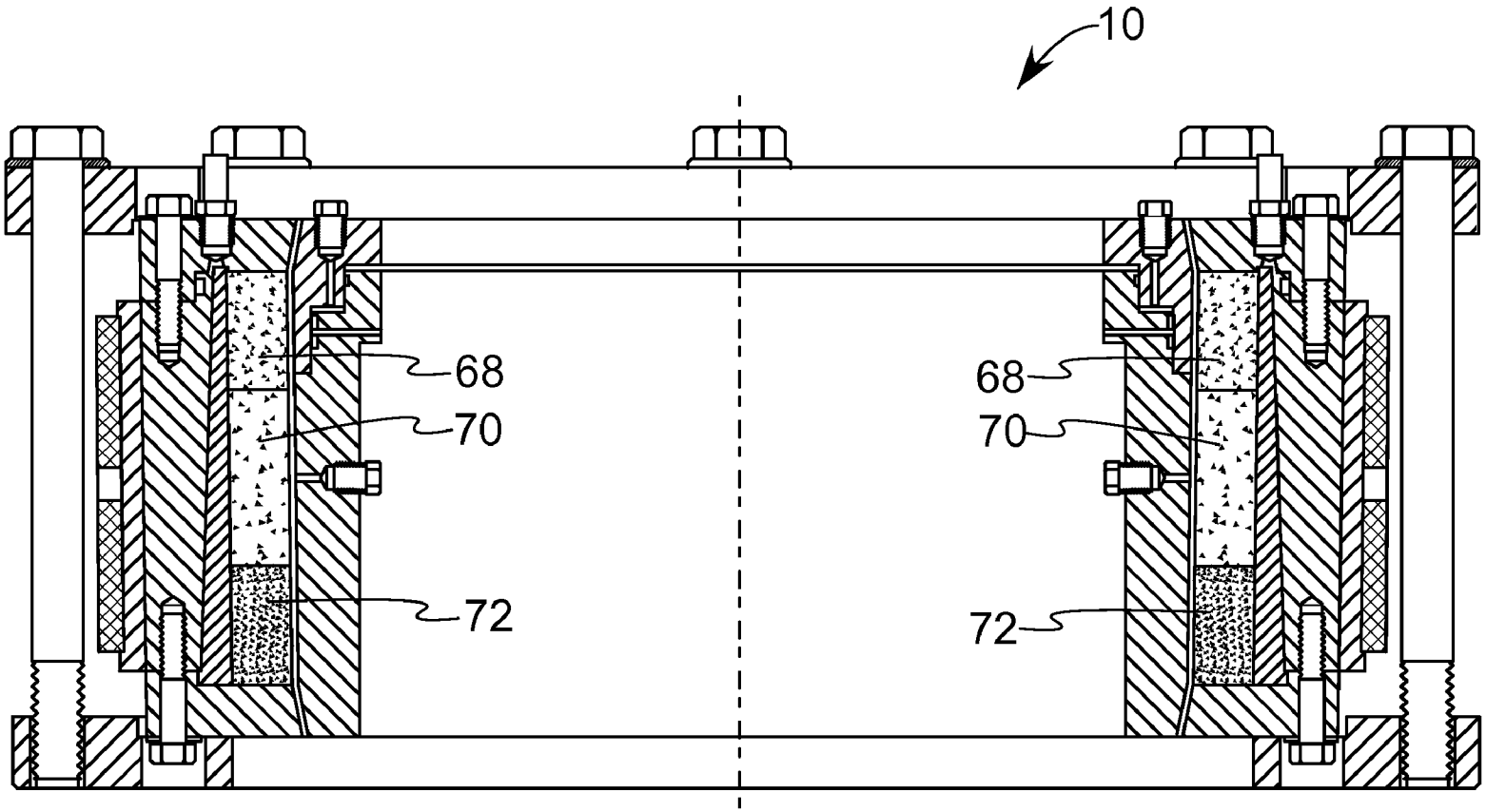

In FIG. 4, a plurality of cylindrical segments, such as 68, 70 and 72, each comprising a selected abrasive molding composition, are sequentially loaded into the mold space 36 and processed according to the present invention. The final product is an annular grinding wheel surface having different cylindrically oriented strips of different abrasive compositions across its axial dimension.

These embodiments shown in FIGS. 2-5B merely illustrate the flexibility of the apparatus and method of the present invention to create a variety of annular shapes, sizes and combining different areas of abrasive characteristics from the same size pressing apparatus and mold space in an inexpensive and relatively easy manner.

In addition to producing complex shaped products in an inexpensive, improved and novel manner, the savings in capital costs and expensive new steel molds, such as those used in conventional prior apparatus and methods, are very significant.

It should also be noted that making good quality, large grinding wheel shapes in a single mold cycle employing the type of abrasive compositions noted herein have heretofore been limited to about two (2) inches in the axial direction. On the other hand, in accordance with the present invention, such grinding wheel shapes may be made in a single molding cycle having axial length dimensions only limited by the practical consideration of the size and weight of the pressing apparatus constructed in accordance with the present invention. Axial lengths from 4 to about 24 inches or more are highly practical in accordance with the present invention. About 24 inches currently represents most of the largest grinding wheels presently employed in industrial machines requiring large grinding wheels. It is believed that even a four inch axial depth grinding wheel of this type has not been satisfactorily manufactured in a single molding cycle which meets practical industrial quality requirements using prior methods and means.

Further, it is pointed out that the use of the flexible membrane as one of the pressing surfaces in compression molding the type of abrasive compositions described herein renders more uniform density in the final product which is valuable even when used in making lap configuration abrasive tool surfaces. The flexible pressing surface allows pressure to be exerted more uniformly across the depth of the mold composition as compared to the inflexible plungers or platens used in the prior art. Therefore, using the apparatus 10 easily modified into a more linear shaped mold configuration allows the manufacture of generally disk shaped or rectangular shaped lap configurations of highly uniform density and surface hardness to be made in a very economical manner.

Figure 9:
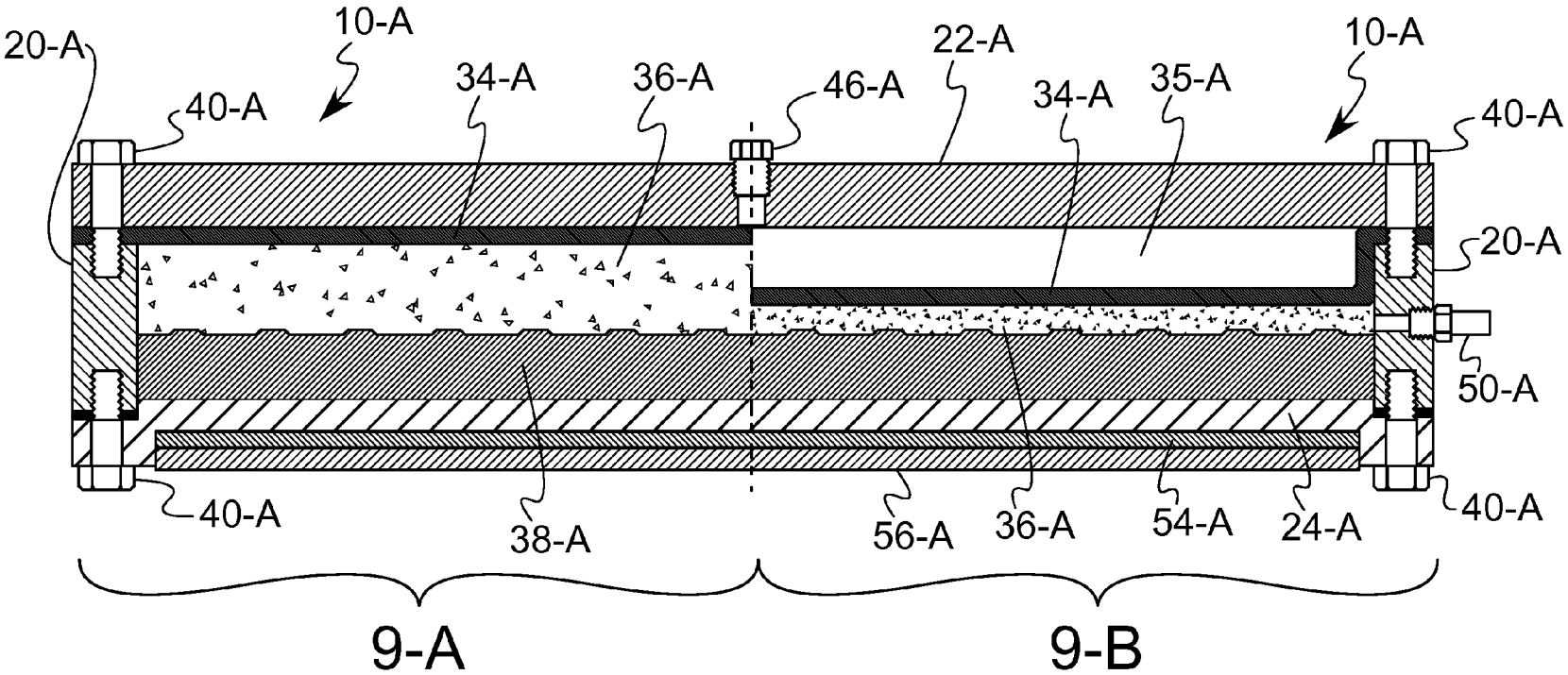
FIGS. 9-A and 9-B are a side sectional view of another embodiment of the present invention illustrating a pressing and molding apparatus for making an abrasive layer for a lap configuration constructed in accordance with the present invention.

An example of such a modified apparatus is illustrated in FIGS. 9-A and 9-B. The same or similar counterparts of the elements of the apparatus shown in FIG. 1 carry the same reference numerals in FIG. 9, followed by the letter A. FIG. 9-A shows only the left half of apparatus 10-A with the mold space initially loaded with the abrasive molding composition. FIG. 9-B illustrates the final shape of the mold space in a compressed configuration.

The compression molding apparatus 10-A includes an outer housing 20-A which conforms generally to the outer shape of the desired abrasive layer formed. A top wall 22-A and a bottom wall 24-A are removably fixed to housing 20-A via threaded bolts, such as at 40-A.

A flexible wall or membrane 34-A, of similar material as that used in the other embodiments described herein, is disposed adjacent to top wall 22-A. Flexible wall or membrane 34-A is sealingly fixed around its perimeter between top wall 22-A and housing 20-A to form pressure chamber 35-A in a manner allowing a major interior surface of flexible membrane 34-A to expand upon exerting fluid pressure introduced through a port 46-A. Upon operatively connecting port 46-A to pressure, such as nitrogen gas described previously herein, the major surface of membrane 34-A interiorly disposed relative to its fixed perimeter may expand and move toward a mold space 36-A defined between membrane 34-A and removably mounted insert 38-A which forms the opposing fixed wall of mold space 36-A. Insert 38-A is removably fixed between bottom wall 24-A and housing 20-A upon assembly of the apparatus 10-A and preferably comprises bronze.

A heat transfer plate 54-A, preferably of aluminum as earlier described, is mounted in engagement with bottom wall 24-A and in engagement with a conventional heating means 56-A, both for the same purpose and function as their counterparts in the apparatus of FIG. 1.

A second fluid port 50-A may be provided through housing 20-A and communicated with mold space 36-A if a vacuum is desired to be employed for similar purposes as described in operating the apparatus of FIG. 1.

It should be apparent to one of ordinary skill that the method of use of the embodiment of FIG. 9 is the same in all essential aspects as the annular embodiments previously described herein. Further, the insert 38-A is shown with a specific ridged surface, however, it may be formed in a flat or other shape as may be desired to impart a particular contour to the surface of abrasive composition layer formed.

Such planar molded abrasive compositions would be mounted to a suitable supporting backing plate, or the like, using well-known conventional methods to complete the tool.

In the manufacture of molded superabrasive tools of the type referenced herein, it is generally accepted by those skilled in the art that surface hardness of the final abrasive composition formed is sensitive to non-uniform density of the molded product if the other variables of the process, such as composition, temperature of processing and applied pressure remain essentially the same.

Surface hardness is a reliable test for quality control since variation of surface hardness in the abrasive layer leads to a variance in wear resistance and a resulting variance in the finish applied to the surface being ground.

To compare a centerless diamond abrasive wheel made in accordance with the present invention, with a grinding wheel made using the prior molding process, the following test was run.

A centerless grinding wheel having a nominal 8×8×½ inches was made in accordance with a one cycle molding process essentially the same to that set forth in Example 1.

A second centerless grinding wheel having the nominal 8×8×½ inch dimensions was made using the conventional prior art axially directed compression molding press and molds to create four annular rings approximately 8×2×½ inch. These rings were conventionally assembled to provide the final 8×8×½ inch centerless wheel. The abrasive compositions employed were the same, however, the maximum pressure applied using the conventional molding and pressing process was about 2000 psi.

Six evenly, circumferentially spaced hardness tests were performed on the wheel made in accordance with the present invention at one inch intervals along the axial length. The same type of hardness tests were conducted on a circumferential line near each axial end of the 2 inch long annular abrasive rings used to create the 8×8×½ ring according to the prior art process. These tests were conducted using 60 kg and a ⅛ inch ball according to standards well-known to one skilled in the art.

The hardness measurements of the 8 inch long, one-piece grinding wheel made in accordance with the present invention varied between 116 to 117 HRH. The hardness measurements of the annular components made according to the well-known prior art process varied between 115 to 119 HRH. In two of the 2 inch long rings formed, a variation from 116 to 119 HRH and from 115 to 118 HRH were noted on the same 2 inch ring segment.

Other tests have been conducted which indicated even greater non-uniformity in hardness of ring segments made by the conventional axially directed press method compared to the method and apparatus of the present invention. Further, it should be noted that the present invention provides hardness values at least equal to the conventional method using significantly reduced pressures.

In view of the sensitivity of the density and resulting surface hardness to temperature, pressure and molding composition, it should be readily understood by one skilled in the art that the ability to mold abrasive compositions of greater axial lengths in a single molding cycle yields a more consistent, high quality end product particularly useful in making annular shaped abrasive tools as well as lap configurations of abrasive tools.

It should also be noted that employing the method and apparatus of the present invention to produce compression molded lap shapes of an abrasive composition layer provides a very substantial advantage over the prior art method relative to producing a very consistent density as measured by the uniform surface hardness.

When one considers that the conventional abrasive molding composition include a mixture of fine powders and hard abrasive particles which are intimately mixed, but inherently not perfectly homogeneous, the inflexible pressing surfaces used in the prior art methods tend to result in a higher degree of non-uniform application of pressure across the engaging surfaces of the platens and composition mixture as compared to the flexible sleeve wall 34. The pressure applied by the flexible sleeve 34 conforms more readily to variances of homogeneity of the molding composition during the application of pressure such that the pressure level applied along the engaging surface of the composition very closely approaching the same value across the entire surface engaged by flexible sleeve 34 or its equivalent.

It is believed that this aspect contributes to the more uniform hardness values achieved according to the present invention and likely contributes to reduce the level of applied pressure necessary in order to achieve the degree of hardness desired for a given application when compared to the prior art.

It should also be pointed out that the radially directed pressure provided by the annular configuration in FIG. 1 could be modified to apply the pressure radially from the outside toward the inside with minor modifications of location of the flexible sleeve which should be readily understood by one skilled in this art based upon the above disclosure herein.

While certain preferred embodiments of the present invention have been disclosed in detail, it is to be understood that various modifications may be adopted without departing from the spirit of the invention or scope of the following claims.

The invention claimed is:

1. A centerless grinding wheel comprising an outer annular layer of a molded superabrasive composition and a center core bonded to and supporting said outer layer, wherein the axial length of said wheel is at least four inches and wherein the radially outwardly facing surface of the outer annular layer of the wheel is seamless and is formed from particulate in a single molding cycle, wherein the outer layer has uniform surface characteristics with variations in hardness no greater than about 1.0 HRH, variations in axial length less than about 0.05% and variations in diameter less than about 0.05%.

2. The centerless grinding wheel in accordance with claim 1, wherein the superabrasive constitutes between about 6.0% and about 50% by volume of the outer annular layer.

3. The centerless grinding wheel in accordance with claim 2, wherein the wheel has substantially greater axial length relative to the radial thickness of the outer annular layer.

* * * * *